US010036992B2

(12) United States Patent
Borenstain et al.

(10) Patent No.: US 10,036,992 B2
(45) Date of Patent: Jul. 31, 2018

(54) CLEANING SYSTEM FOR CLEANING A PHOTOCONDUCTIVE SURFACE

(71) Applicant: HP INDIGO B.V., Amstelveen (NL)

(72) Inventors: Shmuel Borenstain, Neve Daniel (IL); David Meshulam, Ness Ziona (IL); Amir Kedem, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/545,961

(22) PCT Filed: Apr. 15, 2015

(86) PCT No.: PCT/EP2015/058186
§ 371 (c)(1),
(2) Date: Jul. 24, 2017

(87) PCT Pub. No.: WO2016/165760
PCT Pub. Date: Oct. 20, 2016

(65) Prior Publication Data

US 2018/0024492 A1 Jan. 25, 2018

(51) Int. Cl.
*G03G 21/00* (2006.01)

(52) U.S. Cl.
CPC ..... *G03G 21/0011* (2013.01); *G03G 21/0076* (2013.01); *G03G 21/0088* (2013.01)

(58) Field of Classification Search
CPC ..... G03G 21/0076; G03G 21/0088; G03G 21/0094; G03G 21/0011; G03G 2221/0036; G03G 15/11
USPC ..... 399/348
See application file for complete search history.

(56) References Cited

U.S. PATENT DOCUMENTS 3,656,200 A 4/1972 Riley et al.
3,918,809 A * 11/1975 Hwa ..... G03G 21/0088 399/348
4,042,415 A * 8/1977 Hwa ..... G03G 21/0088 134/6
4,866,483 A 9/1989 Davis et al.
5,500,660 A 3/1996 Childers et al.
(Continued)

FOREIGN PATENT DOCUMENTS

EP 1574915 9/2005
JP 57169780 10/1982
(Continued)

OTHER PUBLICATIONS

Machine translation of JP 2007-011142 A, publication date of Jan. 18, 2007, printed on Dec. 11, 2017.*
(Continued)

*Primary Examiner* — Sophia S Chen
(74) *Attorney, Agent, or Firm* — HP Inc. Patent Department

(57) ABSTRACT

Cleaning a photoconductive surface (16) from particles and excess fluid with at least two wiper blades, wherein a first wiper blade (12) is to contact the photoconductive surface (16) and to wipe at least some of the particles and at least some of the excess fluid from the photoconductive surface (16) and wherein a second wiper blade (14) is to contact the photoconductive surface (16) and to wipe at least some of the particles and at least some of the excess fluid that have passed the first wiper blade, from the photoconductive surface (16).

15 Claims, 2 Drawing Sheets

(56) References Cited

U.S. PATENT DOCUMENTS

| | | | | |
|---|---|---|---|---|
| 7,010,259 | B2 | 3/2006 | Gila et al. | |
| 7,991,343 | B2 | 8/2011 | Izawa et al. | |
| 8,050,614 | B2 | 11/2011 | Nuriel et al. | |
| 8,086,133 | B2 | 12/2011 | Ziegelmuller et al. | |
| 2005/0201785 | A1* | 9/2005 | Gila ..... | G03G 21/0088 399/348 |
| 2013/0327236 | A1 | 12/2013 | Kahatabi et al. | |

FOREIGN PATENT DOCUMENTS

| | | | | |
|---|---|---|---|---|
| JP | 03-198084 | A | * | 8/1991 |
| JP | H03198084 | | | 8/1991 |
| JP | 2005352310 | | | 12/2005 |
| JP | 2007-011142 | A | * | 1/2007 |

OTHER PUBLICATIONS

Solca, B. "When Digital Becomes Analog", Jan. 3, 2007, 5 pages. http://archive.news.softpedia.com/news/When-Digital-Becomes-Analog-43505.shtml.

* cited by examiner

CLEANING SYSTEM FOR CLEANING A PHOTOCONDUCTIVE SURFACE

Liquid electrophotography (LEP) printing involves the use of ink (liquid toner) or other printing fluid which includes small color particles suspended in a fluid (imaging oil) that can be attracted or repelled to a photoconductive surface of a photo imaging plate (PIP). In LEP printing apparatuses, a charge roller (CR) may be used to charge the photoconductive surface which is then at least partially discharged, for example by a laser, to provide for a latent image on the photoconductive surface. For each color used, the printing fluid may be provided to a respective latent image on the PIP by a binary ink developer (BID). The resulting fluid images may be transferred from the PIP onto an intermediate transfer member (ITM) for curing and may subsequently be transferred from the ITM to print media.

To maintain high print-quality, residues of ink not transferred to the ITM may be removed from the photoconductive surface of the PIP by a cleaning system having a wiper blade that wipes ink residues from the photoconductive surface.

BRIEF DESCRIPTION OF DRAWINGS

Certain examples are described in the following detailed description and in reference to the drawings, in which.

DETAILED DESCRIPTION

In some LEP printing apparatuses, a print-quality issue sometimes referred to as "CR rings" may occur. CR (charge roller) rings may involve stripes on a print medium extending in a process direction, i.e. the direction in which the print medium is transported when being printed on, wherein the stripes have a color that is darker or brighter than intended. When CR rings occur, the printing process might have to be stopped and the PIP and possibly the CR might have to be replaced, which limits the efficiency of the printing apparatus.

The occurrence of CR rings correlates with the presence of oxidized imaging oil (IO) stripes or imaging oil rings on the PIP. Oxidized imaging oil can be caused in LEP printing apparatuses having a cleaning system with a single wiper blade by imaging oil wakes created by erosion of the single wiper blade due to impinging particles, e.g., ink-residues on the PIP after transfer of the liquid image to the ITM. The evolution of the imaging oil wake is such that at the beginning imaging oil wake dilutes the ink at the BIDs and thus creates bright stripes on the prints. Later, after passing many times under the CR, imaging oil wakes may oxidize, which can result in a rise in viscosity of the oxidized imaging oil. Due to the raised viscosity of the oxidized imaging oil, differences in charging uniformity caused by the growing oxidized imaging oil stripe or ring may become visible as dark stripes on the print media. In consequence, the PIP and possibly the CR that may have been negatively affected by the oxidized imaging oil might have to be replaced.

The lifespan of the PIP and the CR can be extended by cleaning the PIP with two wiper blades arranged one after the other in the process direction, i.e., the direction of motion of the PIP surface. In particular, a second wiper blade arranged after the first wiper blade in the direction of motion of the PIP surface wipes the imaging oil of the imaging oil wakes of the eroded first wiper blade so that no oxidized imaging oil stripes or rings are generated, thereby maintaining charging uniformity of the photoconductive surface of the PIP. Thus, a second wiper blade that removes excess fluid such as oxidizable imaging oil from the photoconductive surface, i.e., a second wiper blade that generates a uniform or smoothed distribution of imaging oil on the photoconductive surface, can increase the lifespan of the photoconductive surface.

Figure 1:
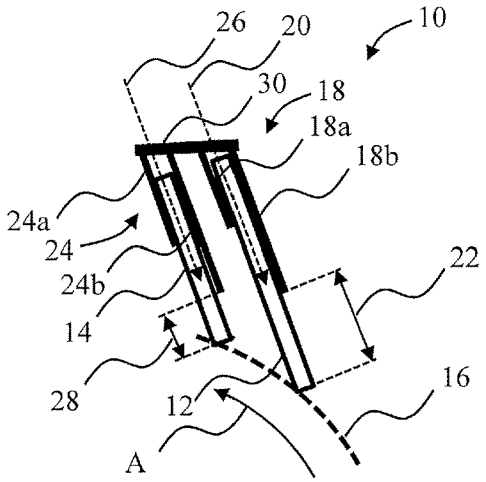
FIG. 1 shows a schematic cross-sectional view of an example of a cleaning system.

FIG. 1 shows a schematic cross-sectional view of an example of a cleaning system 10. The cleaning system 10 of this example comprises a first wiper blade 12 and a second wiper blade 14. The first wiper blade 12 is arranged to contact a photoconductive surface 16 of a PIP (photo imaging plate) 38 to wipe at least some of the particles and at least some of an excess fluid from the photoconductive surface 16. The second wiper blade 14 is arranged at a predetermined distance from the first wiper blade 12, in a moving direction of the photoconductive surface 16 downstream of the first wiper blade 12, indicated by the arrow A in FIG. 1. Like the first wiper blade 12, the second wiper 14 blade is arranged to contact the photoconductive surface 16 of the PIP 38 and to wipe at least some of the particles and at least some of the excess fluid that have passed the first wiper blade 12, from the photoconductive surface 16.

The first wiper blade 12 is attached to a first support 18 comprising a first arm 18*a* and a second arm 18*b* which sandwich the first wiper blade 12, wherein the first arm 18*a* and the second arm 18*b* may have different lengths as shown in FIG. 1. The first support 18 may be coupled to an attachment portion (not shown) for mounting the first support 18 in a predetermined position relative to the photoconductive surface 16. When mounted, a length direction 20 of the first wiper blade 12, i.e., a direction in which the first wiper blade 12 extends along one of its axes, may be oriented or inclined towards the photoconductive surface 16 and a width direction of the first wiper blade 12, orthogonal to the length direction 20, may be oriented in parallel to the photoconductive surface 16 (or parallel to a tangent plane of the photoconductive surface 16 if the photoconductive surface 16 is curved).

A length of a free portion 22 of the first wiper blade 12, i.e. a portion of the first wiper blade 12 extending beyond the first arm 18*a* and the second arm 18*b* in the length direction 20, e.g. parallel to an edge of the first wiper blade 12 when the first wiper blade 12 is in an unbend state, may be designed to be larger than a space between the photoconductive surface 16 and the first support 18. As a result, the free portion 22 of the first wiper blade 12 may be forced to flex away from the surface of the PIP 38 to fit the space. More particularly, the length of the first wiper blade 12 in the length direction 20 of the first wiper blade 12 (in an unbend state) may be chosen to force the free portion 22 of the first wiper blade 12 to bend away from the photoconductive surface 16 when the first support 18 is mounted relative to the photoconductive surface 16. The resulting bent (deflection) may be designed to produce the desired pressing force when the first support 18 is, for example, mounted in the apparatus 32 of FIG. 2. As a result, the resilience of the first wiper blade 12 presses an end surface of the free portion 22 of the first wiper blade 12 against the photoconductive surface 16.

Given a predetermined distance between a mounting position of the first support 18 and the photoconductive surface 16, the length of the second arm 18*b* in the length direction 20 of the first wiper blade 12 may be chosen to achieve a first predetermined pressing force between a (contact) surface of the first wiper blade 12 and the photoconductive surface 16. For example, the first predetermined pressing force may be calculated or looked-up as a function of the elasticity of a chosen material of the first wiper blade 12 and a chosen length and thickness of the free portion 22.

The second wiper blade 14 is attached to a second support 24 having a first arm 24*a* and a second arm 24*b* which sandwich the second wiper blade 14, wherein the first arm 24*a* and the second arm 24*b* may have different lengths as shown in FIG. 1. The second support 24 may be coupled to the attachment portion (not shown) for mounting the second support 24 in a predetermined position relative to the photoconductive surface 16. When mounted, a length direction 26 of the second wiper blade 14, i.e., a direction in which the second wiper blade 14 extends along one of its axes, may be directed towards the photoconductive surface 16 and a width direction of the second wiper blade 14 which is orthogonal to the length direction 26 may be parallel to the photoconductive surface 16.

A length of a free portion 28 of the second wiper blade 14, i.e. a portion of the second wiper blade 14 extending beyond the first arm 24*a* and the second arm 24*b* in the length direction 26, e.g. parallel to an edge of the second wiper blade 14 when the second wiper blade 14 is in an unbend state, may be designed to be larger than a space between the photoconductive surface 16 and the second support 24. As a result, the free portion 28 of the second wiper blade 14 may be forced to flex away from the surface of the PIP 38 to fit the space. More particularly, the length of the second wiper blade 14 in the length direction 26 of the second wiper blade 14 (in an unbend state) may be chosen to force the free portion 28 of the second wiper blade 14 to bend away from the photoconductive surface 16 when the second support 24 is mounted relative to the photoconductive surface 16. The resulting bend (deflection) may be designed to produce the desired pressing force when the second support 24 is mounted e.g. to the apparatus 32 of FIG. 2. As a result, the resilience of the second wiper blade 14 would press an end surface of the free portion 28 of the second wiper blade 14 against the photoconductive surface 16.

Given a predetermined distance between a mounting position of the second support 24 and the photoconductive surface 16, the length of the second arm 24*b* in the length direction 26 of the second wiper blade 14 may be chosen to achieve a second predetermined pressing force between a surface of the second wiper blade 14 and the photoconductive surface 16. For example, the second predetermined pressing force may be calculated or looked-up as a function of the elasticity of a chosen material of the second wiper blade 14 and a chosen length and thickness of the free portion 28. For example, the first wiper blade 12 and the second wiper blade 14 may be made of a same material and have the same thickness and the same or different lengths of the free portions 22 and 28 to achieve the same or different first and second predetermined pressing forces.

In an example, the pressing force between the first wiper blade 12 and the photoconductive surface 16 can be in a range of 20 N/m to 50 N/m and the pressing force between the second wiper blade 14 and the photoconductive surface 16 can be in a range of 50 N/m to 200 N/m. Furthermore, the first wiper blade 12 and the second wiper blade 14 can be made of polyurethane, plastics, or another suitable material with a shore A hardness in a range of 70 to 80. Moreover, a thickness of the first wiper blade 12 and a thickness of the second wiper blade 14 can be in a range of 2 to 4 millimeters and can be identical. Having the first wiper blade 12 and the second wiper blade 14 with similar dimensions may increase production efficiency.

The free length of the first wiper blade 12, i.e., the length of the portion 22 of the first wiper blade 12 extending from the second arm 18*b*, can be in a range of 10 to 13 millimeters and the free length of the second wiper blade 14, i.e., the length of the portion 28 of the second wiper blade 14 extending from the second arm 24*b*, can be in a range of 5 to 7 millimeters so that the second predetermined pressing force is higher than the first predetermined pressing force, e.g., by a factor greater than 2 or in a range of 2 to 10.

Making the second pressing force applied by the second wiper blade 14 higher than the first pressing force may reduce the risk of scratches in the photoconductive surface 16 due to the lower pressing force of the first wiper blade 12, while the higher pressing force of the second wiper blade 14 may safely wipe excess fluid which passes the first wiper blade 12. In another example, the pressure between a contact area of the first wiper blade 12 and the photoconductive surface 16 may be above 100,000 $N/m^2$ and the pressure between a contact area of the second wiper blade 14 and the photoconductive surface 16 may be above 100,000 $N/m^2$ and preferably above 1,000,000 $N/m^2$.

An angle between the length direction 20 of the first wiper blade 12 and the length direction 26 of the second wiper blade 14 may be less than 60° or less than 30°. In the example shown in FIG. 1, the length direction 20 of the first wiper blade 12 and the length direction 26 of the second wiper blade 14 may be parallel to achieve a small form factor. An angle between the length direction 20 of the first wiper blade 12 and a tangent to the photoconductive surface 16 at a contact area between the first wiper blade 12 and the photoconductive surface 16, the tangent being orthogonal to the width direction of the first wiper blade 12, may be about 26° or in a range of 10° to 45°. An angle between the length direction 26 of the second wiper blade 14 and a tangent to the photoconductive surface 16 at a contact area between the second wiper blade 14 and the photoconductive surface 16, the tangent being orthogonal to a width direction of the second wiper blade 14, may be about 29° or in a range of 10° to 45°. The width of the first wiper blade 12 which is orthogonal to the length direction 20 of the first wiper blade 12 may be above 30 millimeters, 100 millimeters, 300 millimeters, 500 millimeters or above 700 millimeters. Moreover, the width of the first wiper blade 12 may be below 1500 millimeters or below 1000 millimeters. The width of the second wiper blade 14 which is orthogonal to the length direction 26 of the second wiper blade 14 may be above 30 millimeters, 100 millimeters, 300 millimeters, 500 millimeters or above 700 millimeters. Furthermore, the width of the second wiper blade 14 may be below 1500 millimeters or below 1000 millimeters. In an example, the width of the first wiper blade 12 and the width of the second wiper blade 14 do not differ by more than 10 millimeters or are identical. In another example, the width of the first wiper blade 12 and the width of the second wiper blade 14 are wider than a width of the photoconductive surface 16.

The support of the first wiper blade 12 and the support of the second wiper blade 14 may be formed integrally as shown in FIG. 1, thereby forming a double wiper support structure 30 that comprises the first support 18 and the second support 24. Furthermore, the double wiper support structure 30 may comprise the attachment portion (not shown) for mounting the double wiper support structure 30 relative to the photoconductive surface 16. In an example, the attachment portion may have an adapter that is substantially identical to corresponding adapters of single wiper support structures so that the double wiper support structure 30 can be inserted into the same fitting as used for mounting the single wiper support structures.

Figure 2:
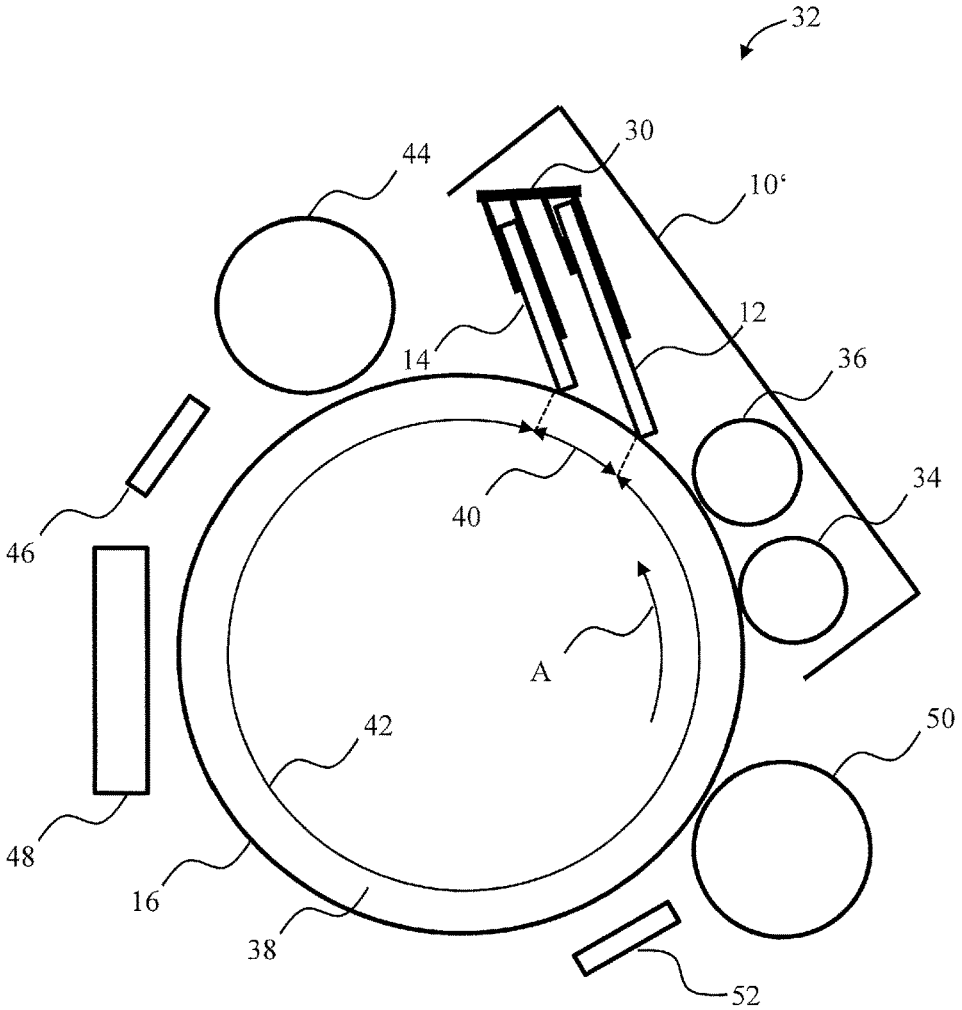
FIG. 2 shows a schematic cross-sectional view of an example of an apparatus comprising a cleaning system.

FIG. 2 shows a schematic view of an apparatus 32 comprising a cleaning system 10' according to an example. The cleaning system 10' comprises the first wiper blade 12 and the second wiper blade 14 described with reference to FIG. 1 mounted to the double wiper support structure 30. Furthermore, the cleaning system 10' comprises a first applicator unit 34 and a second applicator unit 36 which may provide a maintenance fluid such as for example imaging oil to the photoconductive surface 16. The photoconductive surface 16 is, for example, formed by a photoconductive foil wrapped around a PIP 38. The PIP may be drum-shaped or may be a transfer member having another shape, such as a belt or other configuration. Furthermore, each of the first applicator unit 34 and the second applicator unit 36 may comprise a sponge applicator that contacts the photoconductive surface 16.

As shown in FIG. 2, the first applicator unit 34 and the second applicator unit 36 may provide the maintenance fluid to the photoconductive surface 16 outside a motion path segment 40 of a motion path of the photoconductive surface 16 formed between the contact areas of the photoconductive surface 16 and the first wiper blade 12 and the second wiper blade 14, respectively. In FIG. 2, the motion of the photoconductive surface 16, in this example the rotation direction of the drum-shaped PIP 38, is indicated by arrow A. Because the first applicator unit 34 and the second applicator unit 36 are arranged along a motion path segment 42 of a motion path of the photoconductive surface 16, formed between the contact areas of the photoconductive surface 16 and the second wiper blade 14 and the first wiper blade 12, respectively, i.e. outside of the motion path segment 40, the second wiper blade 14 can wipe the imaging oil wakes that pass the first wiper blade 12. If there is erosion of the second wiper blade 14, previously caused by particles passing the first wiper blade 12 and impinging on the second wiper blade 14, this erosion would allow imaging oil wakes to pass the second wiper blade 14 if the first wiper blade 12 is eroded at a exactly the same location in the width direction. Otherwise, imaging oil wakes passing the first wiper blade 12 are wiped by the second wiper blade 14. Thus, the mean amount of excess imaging oil wakes passing the second wiper blade 14 towards the CR 44 can be reduced.

In another example, the second applicator unit 36 may provide the maintenance fluid to the photoconductive surface 16 inside the motion path segment 40 and the second wiper blade 14 may be adapted to prevent erosion of the second wiper blade 14, for example by being made of a harder material than the first wiper blade 12.

The apparatus 32 may further comprise a first discharge device 46 such as, for example, a laser device, for discharging portions of the photoconductive surface 16 charged by the CR 44 to produce latent images. Moreover, the apparatus 32 may comprise a BIDs (binary ink developers) unit 46 for applying ink, i.e., charged liquid toner comprising color particles and imaging oil, to the latent images on the photoconductive surface 16, thereby producing liquid images. Before transferring the liquid images to an ITM 50 (intermediate transfer member), a remaining charge on the photoconductive surface 16 is removed by a second discharge device 52 such as, for example, a set of diodes. On the ITM 50, the fluid images can be cured, for example, by heating and then transferred from the ITM 50 to the print media. Moreover, although a CR 44 is presented herein as a specific example of a charging device, other charging device such as, for example, a scorotron, may be used in the apparatus 32.

Figure 3:
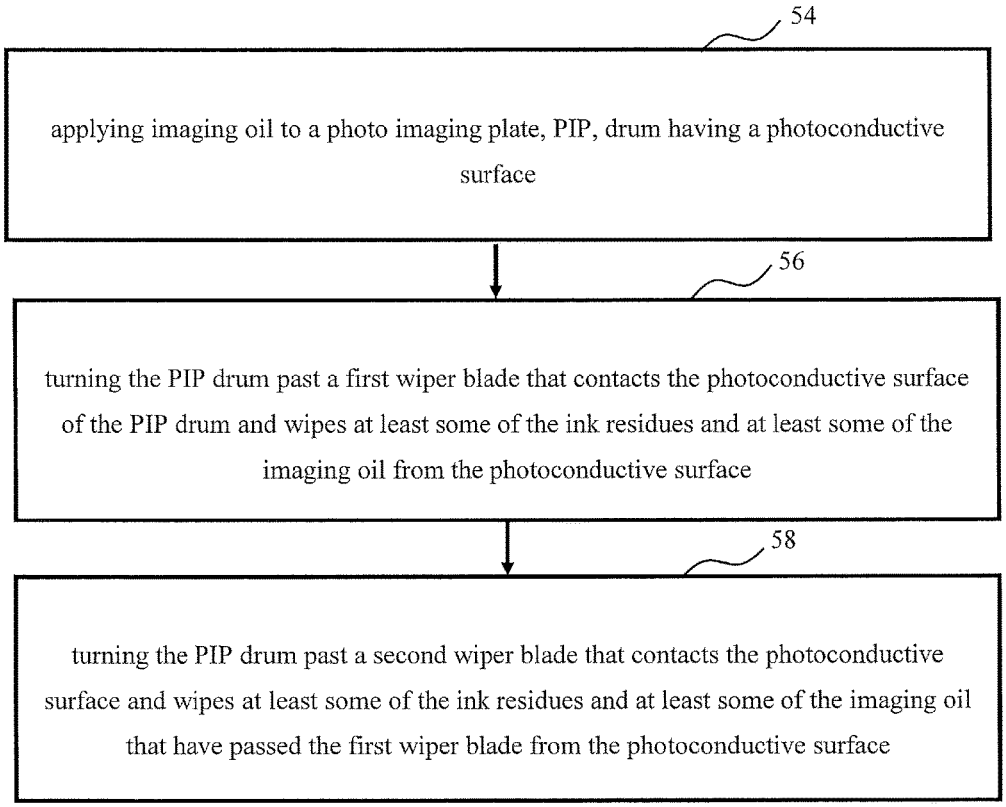
FIG. 3 shows a flow diagram of a process of cleaning a photoconductive surface according to an example.

FIG. 3 shows a flow diagram of a process of cleaning the photoconductive surface 16 which may, for example, be carried out in apparatus 32. The process starts at 54 with applying, e.g., by the imaging oil applicator units 34, 36, imaging oil to the photoconductive surface 16 of the PIP 38 drum. The process continues at 56 with turning, e.g., by a drive, the PIP 38 drum past the first wiper blade 12 that contacts the photoconductive surface 16 of the PIP 38 drum and wipes at least some of the ink residues and at least some of the imaging oil from the photoconductive surface 16. At 58, the PIP 38 is turned past the second wiper blade 14 that contacts the photoconductive surface 16 and wipes at least some of the ink residues and at least some of the imaging oil that have passed the first wiper blade 12 from the photoconductive surface 16.

As explained above, wiping the excess imaging oil that passes the first wiper blade 12 by providing the second wiper blade 14 drastically reduces a probability of imaging oil wakes passing the second wiper blade 14 and thus increases the lifetime and hence the efficiency of a LEP printing apparatus to which the first wiper blade 12 and the second wiper blade 14 are mounted.

LIST OF REFERENCE SIGNS

10 cleaning system
10' cleaning system
12 first wiper blade
14 second wiper blade
16 photoconductive surface
18 first support
**18*a*** first arm of first support
**18*b*** second arm of first support
20 length direction of first wiper blade
22 free portion of first wiper blade
24 second support
**24*a*** first arm of second support
**24*b*** second arm of second support
26 length direction of second wiper blade
28 free portion of second wiper blade
30 double wiper support structure
32 apparatus
34 first applicator unit
36 second applicator unit
38 photo imaging plate (PIP)
40 motion path segment
42 motion path segment
44 charge roller (CR)
46 first discharge device
48 binary ink developers (BIDs) unit
50 intermediate transfer member
52 second discharge device
54-58 process elements

The invention claimed is:

1. A cleaning system for cleaning a photoconductive surface from particles and excess fluid, the photoconductive surface moving relative to the cleaning system, the cleaning system comprising:

at least two wiper blades comprising a first wiper blade and a second wiper blade; the first wiper blade to contact the photoconductive surface and to wipe at least some of the particles and at least some of the excess fluid from the photoconductive surface, the first wiper blade being attached to a first support having first arms, the first wiper blade having a first free portion extending beyond the first arms; and the second wiper blade to contact the photoconductive surface and to wipe at least some of the particles and at least some of the excess fluid that have passed the first wiper blade, from the photoconductive surface, the second wiper blade being attached a second support having second arms, the second wiper blade having second free portion extending beyond the second arms, and the second free portion having a different length than the first free portion.

2. The cleaning system of claim 1, wherein the excess fluid is a maintenance fluid and the system further comprises at least one applicator units to provide the maintenance fluid to the photoconductive surface.

3. The cleaning system of claim 2, wherein the at least one applicator units provide the maintenance fluid to the photoconductive surface outside a motion path segment of a motion path of the photoconductive surface, wherein the motion path segment is defined between the contact areas of the photoconductive surface and the first and second wiper blade, respectively.

4. The cleaning system of claim 3, wherein the particles are liquid toner residues and the maintenance fluid is imaging oil.

5. The cleaning system of claim 3, wherein each applicator unit comprises a sponge applicator which is arranged to contact the photoconductive surface to provide the maintenance fluid to the photoconductive surface.

6. The cleaning system of claim 1, wherein the first support of the first wiper blade and the second support of the second wiper blade are formed integrally.

7. The cleaning system of claim 1, wherein an angle between a length direction of the first wiper blade and a length direction of the second wiper blade is less than 60°.

8. An apparatus comprising a member having a photoconductive surface and a cleaning system for cleaning the photoconductive surface from particles and excess fluid, the photoconductive surface moving relative to the cleaning system, the cleaning system comprising:

at least two wiper blades comprising a first wiper blade and a second wiper blade;

the first wiper blade to contact the photoconductive surface and to wipe at least some of the particles and at least some of the excess fluid from the photoconductive surface, the first wiper blade being attached to a first support having first arms, the first wiper blade having a first free portion extending beyond the first arms; and the second wiper blade to contact the photoconductive surface and to wipe at least some of the particles and at least some of the excess fluid that have passed the first wiper blade, from the photoconductive surface, the second wiper blade being attached a second support having second arms, the second wiper blade having second free portion extending beyond the second arms, and the second free portion having a different length than the first free portion.

9. The apparatus of claim 8, wherein the excess fluid is a maintenance fluid and the apparatus further comprises an intermediate transfer member, ITM, and at least one applicator units to provide the maintenance fluid to the photoconductive surface, wherein the at least one applicator units are arranged along a motion path of the photoconductive surface between the intermediate transfer member and the wiper blades.

10. The apparatus of claim 8, wherein a contact pressure between the photoconductive surface and the first wiper blade and the second wiper blade, respectively, is above 100,000 $N/m^2$.

11. The apparatus of claim 10, wherein the contact pressure between the photoconductive surface and the second wiper blade is above 1,000,000 $N/m^2$.

12. The apparatus of claim 8, wherein the member having the photoconductive surface is a photo imaging plate, PIP, drum and a distance between the first wiper blade and the second wiper blade in a rotation direction of the PIP drum is smaller than a distance between the second wiper blade and the first wiper blade in the rotation direction of the PIP drum and wherein the excess fluid is imaging oil and wherein no imaging oil is provided to the photoconductive surface between the first wiper blade and the second wiper blade.

13. A method of cleaning a photoconductive surface from ink residues and imaging oil, comprising:

applying imaging oil to a photo imaging plate, PIP, drum having a photoconductive surface;

turning the PIP drum past a first wiper blade that contacts the photoconductive surface of the PIP drum and wipes at least some of the ink residues and at least some of the imaging oil from the photoconductive surface; and turning the PIP drum past a second wiper blade that contacts the photoconductive surface and wipes at least some of the ink residues and at least some of the imaging oil that have passed the first wiper blade from the photoconductive surface, wherein the first wiper blade is attached to a first support having first arms, the first wiper blade having a first free portion extending beyond the first arms, the second wiper blade is attached to a second support having second arms, the second wiper blade having a second free portion extending beyond the second arms and having a different length than the first free portion.

14. The method of claim 13, wherein no imaging oil is applied to the photoconductive surface within a motion path segment of a motion path of the photoconductive defined between the contact areas of the photoconductive surface and the first and second wiper blade, respectively.

15. The method of claim 13, wherein all imaging oil is applied to the photoconductive surface within a motion path segment of a motion path of the photoconductive surface defined between the contact areas of the photoconductive surface and the second and the first wiper blade, respectively.

* * * * *